US011529541B1

(12) United States Patent
Inniss

(10) Patent No.: US 11,529,541 B1
(45) Date of Patent: Dec. 20, 2022

(54) WEIGHT ATTACHMENT DEVICE

(71) Applicant: Dennis Inniss, Scarborough (CA)

(72) Inventor: Dennis Inniss, Scarborough (CA)

( * ) Notice: Subject to any disclaimer, the term of this patent is extended or adjusted under 35 U.S.C. 154(b) by 0 days.

(21) Appl. No.: 17/393,472

(22) Filed: Aug. 4, 2021

(51) Int. Cl.
*A63B 21/065* (2006.01)
*A63B 21/072* (2006.01)
*A63B 21/00* (2006.01)

(52) U.S. Cl.
CPC ..... *A63B 21/065* (2013.01); *A63B 21/0726* (2013.01); *A63B 21/4009* (2015.10)

(58) Field of Classification Search
CPC ..... A63B 21/065; A63B 21/0726; A63B 21/4009; A63B 21/00058; A63B 21/00061; A63B 21/00178; A63B 21/4023; A63B 21/4025; A63B 21/4039
See application file for complete search history.

(56) References Cited

U.S. PATENT DOCUMENTS

D329,748 S 9/1992 Ehlin
5,997,494 A * 12/1999 Watkins ..... A61H 1/0218 602/32
6,715,728 B2 4/2004 Nielsen
7,081,071 B2 * 7/2006 Smith ..... A63B 21/065 482/148
7,520,844 B1 * 4/2009 Flynn ..... A63B 21/065 482/108
11,369,831 B2 * 6/2022 Beck ..... A63B 21/065
2005/0065000 A1 * 3/2005 Reinhart ..... A63B 21/4009 482/105
2010/0062911 A1 * 3/2010 Stone ..... A63B 21/065 482/92
2014/0194259 A1 * 7/2014 Alpert ..... A63B 21/065 482/105

* cited by examiner

*Primary Examiner* — Megan Anderson

(57) ABSTRACT

A weight attachment device for attaching dumbbells to a weightlifting belt includes a pair of clamping units, each of which is mountable to respective opposed side of a weightlifting belt so that the clamping units are positioned singly proximate to hips of a user upon donning of the weightlifting belt by the user. Each clamping unit is selectively engageable to a respective dumbbell of a pair of dumbbells so that the respective dumbbell is removably engaged to the clamping unit. The pair of clamping units engages a pair of dumbbells so that the dumbbells are positioned singly proximate to the hips of the user. The user thus is positioned to perform exercises without using their hands to grasp the dumbbells.

11 Claims, 5 Drawing Sheets

WEIGHT ATTACHMENT DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to attachment devices and more particularly pertains to a new attachment device for attaching dumbbells to a weightlifting belt. The present invention discloses an attachment device comprising clamps that are engageable singly to opposed sides of a weightlifting belt, and which actively engage handles of dumbbells.

(2) Description of Related Art Including Information Disclosed Under 37 CFR 1.97 and 1.98

The prior art relates to attachment devices. Prior art attachment devices for securing dumbbells to weightlifting belts may comprise hook shaped attachments for weightlifting belts which do not coupled to a handle of a dumbbell. Other prior art attachment devices may comprise rods, which are attachable to weightlifting belts and insertable into holed weights. What is lacking in the prior art is an attachment device comprising clamps that are engageable singly to opposed sides of a weightlifting belt, and which actively engage handles of dumbbells.

BRIEF SUMMARY OF THE INVENTION

An embodiment of the disclosure meets the needs presented above by generally comprising a pair of clamping units, each of which is configured to be mountable to respective opposed side of a weightlifting belt so that the clamping units are positioned singly proximate to hips of a user upon donning of the weightlifting belt by the user. Each clamping unit is configured to selectively engage a respective dumbbell of a pair of dumbbells so that the respective dumbbell is removably engaged to the clamping unit. The pair of clamping units is configured to engage a pair of dumbbells so that the dumbbells are positioned singly proximate to the hips of the user. The user thus is positioned to perform exercises without using their hands to grasp the dumbbells.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
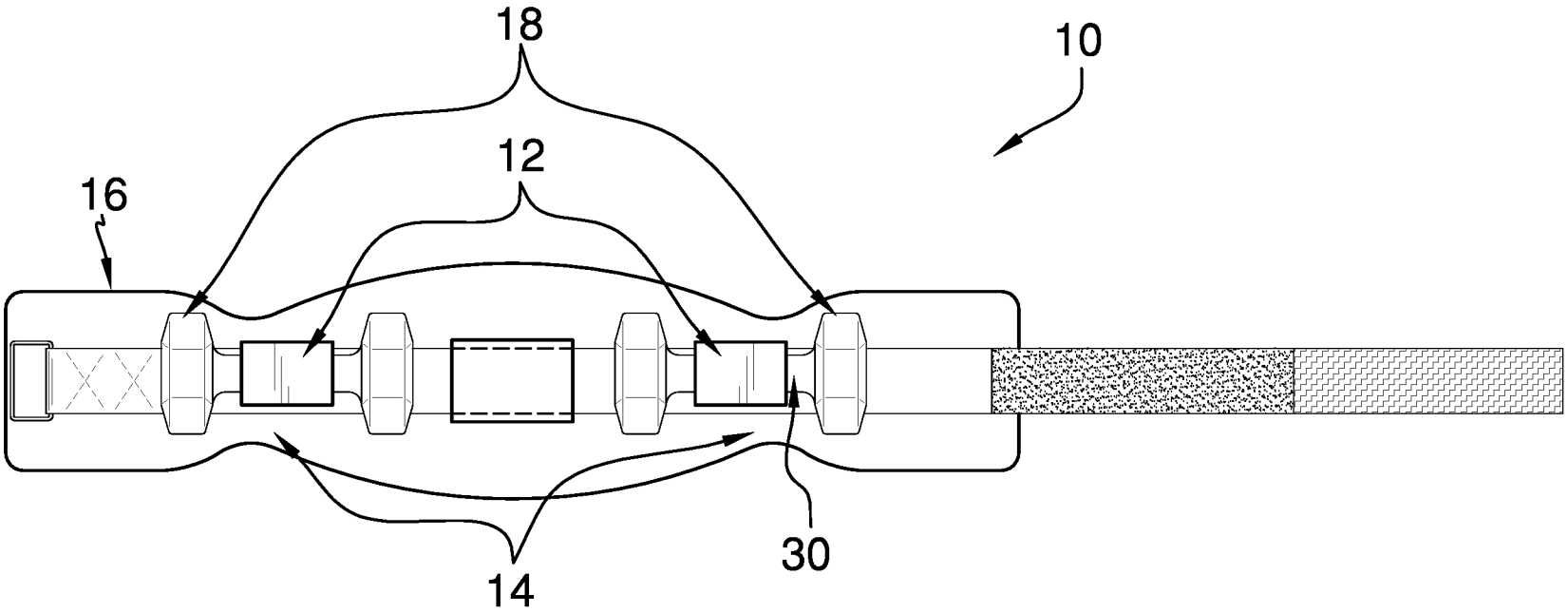
FIG. 1 is a front view of a weight attachment device according to an embodiment of the disclosure.
Figure 2:
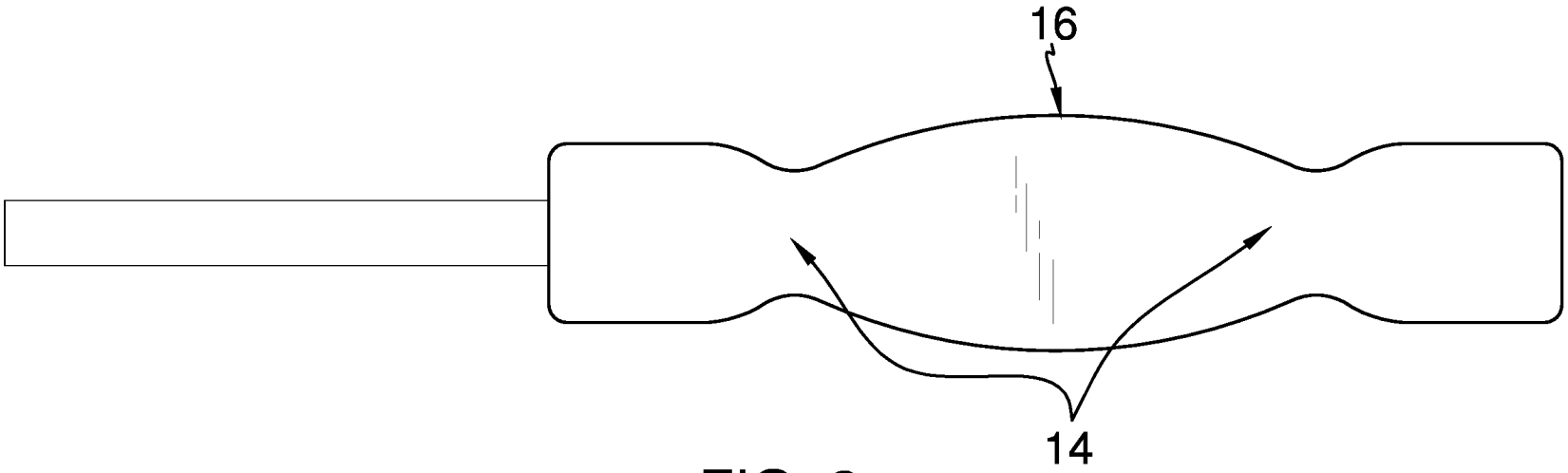
FIG. 2 is a rear view of an embodiment of the disclosure.

With reference now to the drawings, and in particular to FIGS. 1 through 7 thereof, a new attachment device embodying the principles and concepts of an embodiment of the disclosure and generally designated by the reference numeral 10 will be described.

As best illustrated in FIGS. 1 through 7, the weight attachment device 10 generally comprises a pair of clamping units 12, each of which is configured to be mountable to respective opposed side 14 of a weightlifting belt 16 so that the clamping units 12 are positioned singly proximate to hips of a user upon donning of the weightlifting belt 16 by the user. Each clamping unit 12 is configured to selectively engage a respective dumbbell 18 of a pair of dumbbells 18 so that the respective dumbbell 18 is removably engaged to the clamping unit 12. The pair of clamping units 12 is configured to engage a pair of dumbbells 18 so that the dumbbells 18 are positioned singly proximate to the hips of the user. The user thus is positioned to perform exercises without using their hands to grasp the dumbbells 18.

Figure 3:
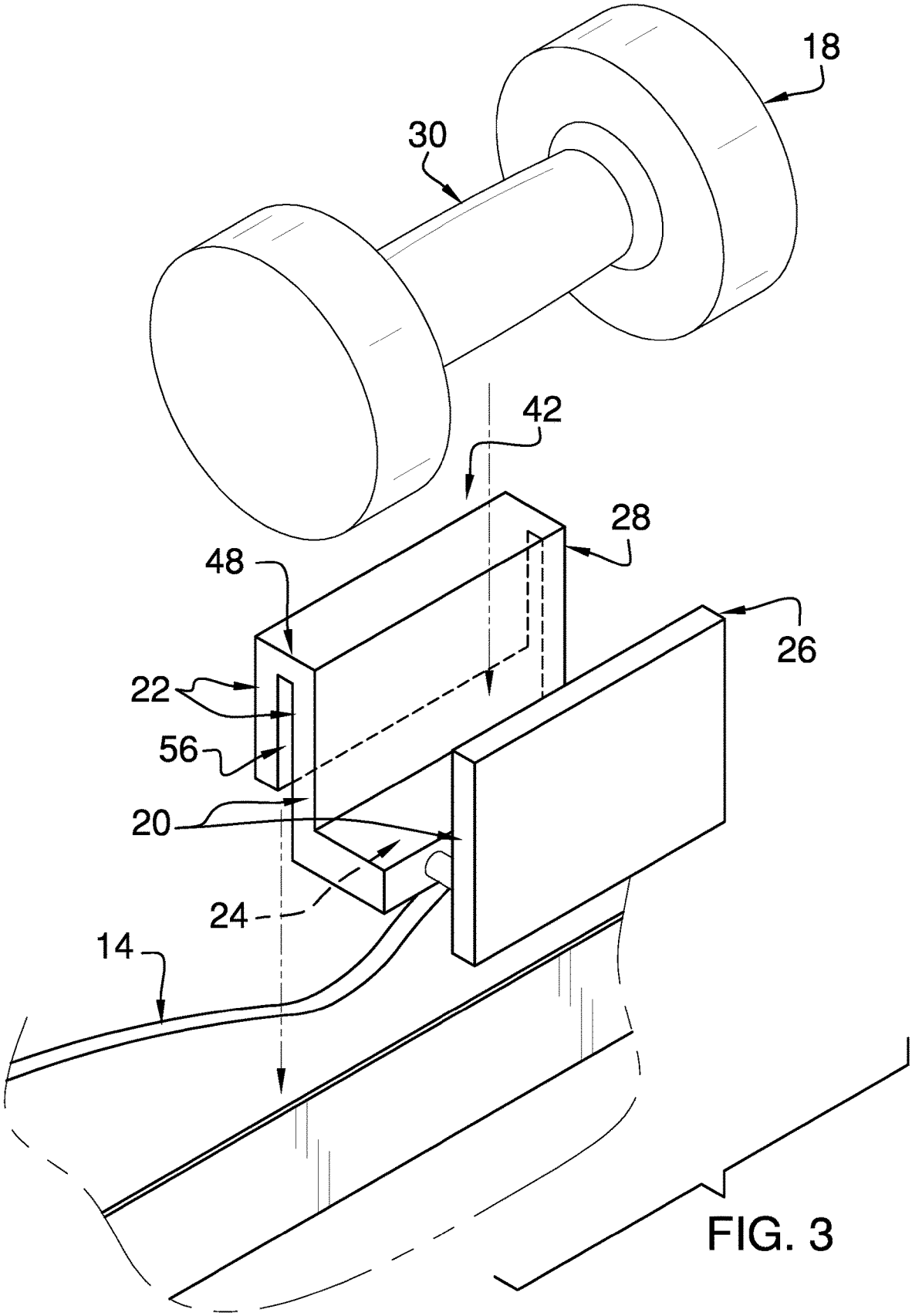
FIG. 3 is a detail view of an embodiment of the disclosure.
Figure 4:
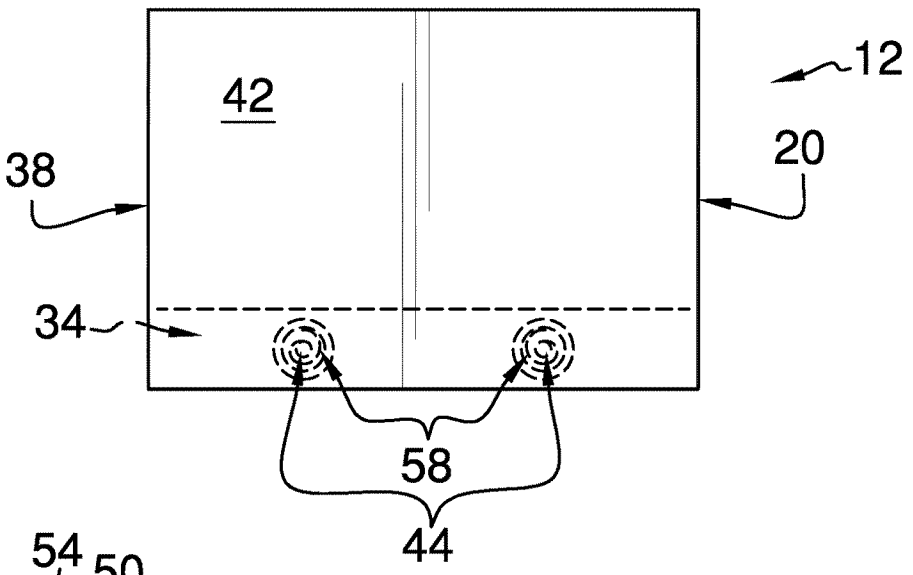
FIG. 4 is a front view of an embodiment of the disclosure.
Figure 6:
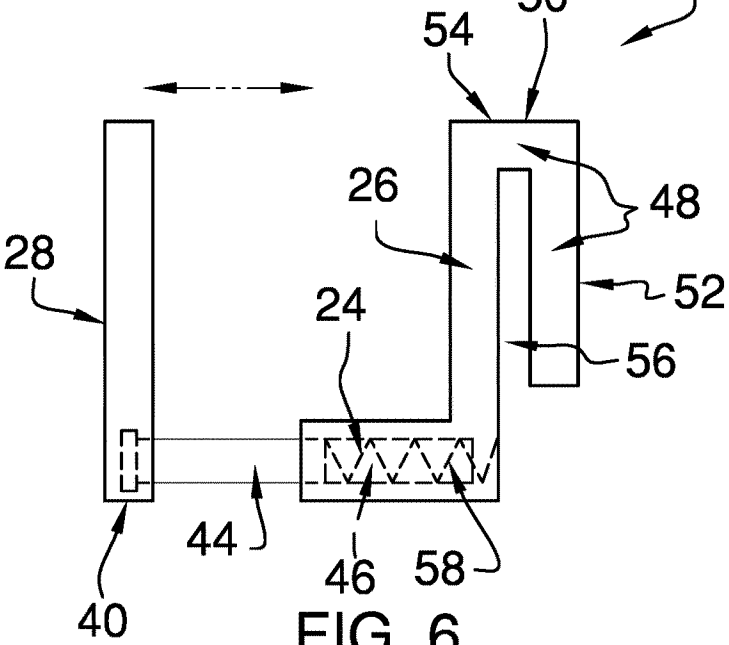
FIG. 6 is a side view of an embodiment of the disclosure in an open configuration.
Figure 5:
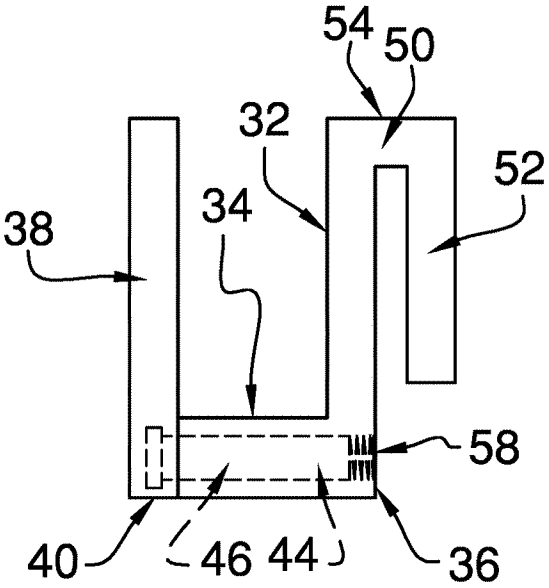
FIG. 5 is a side view of an embodiment of the disclosure in a retracted configuration.
Figure 7:
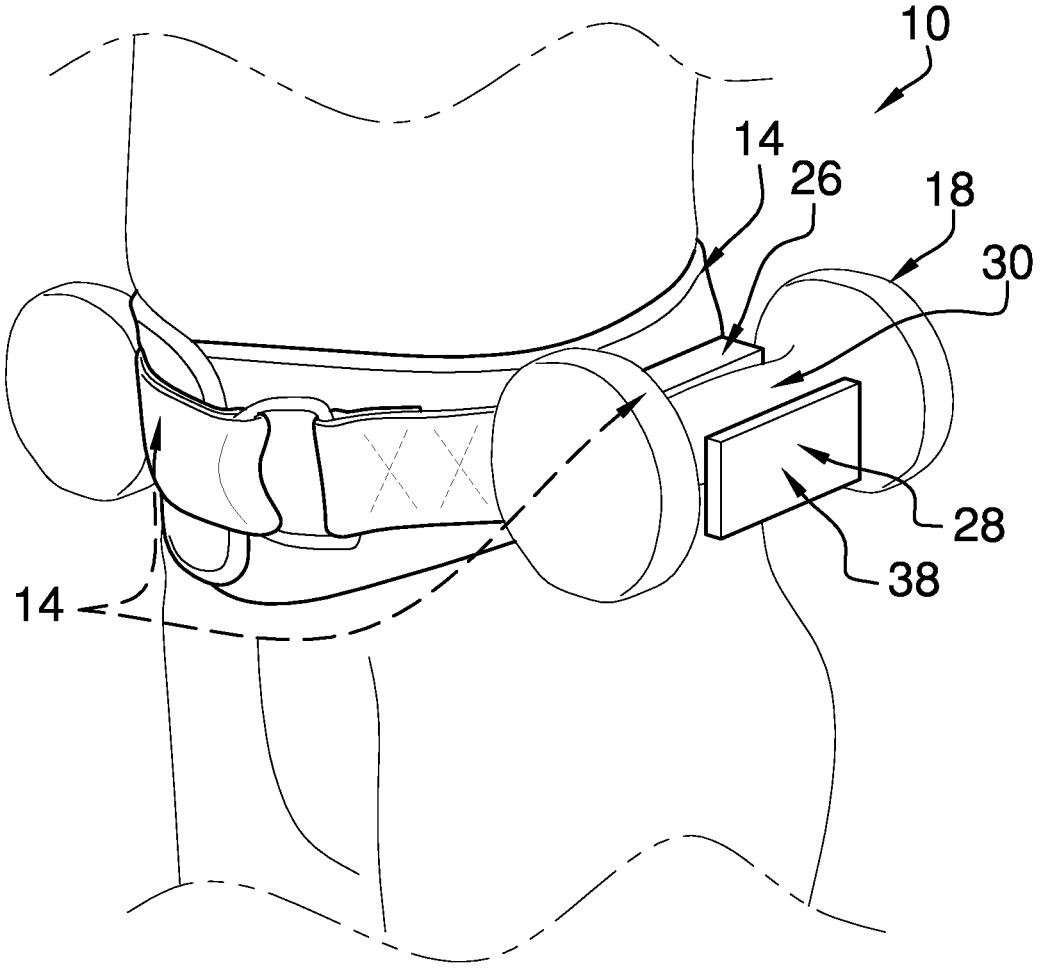
FIG. 7 is an in-use view of an embodiment of the disclosure.

Each clamping unit 12 comprises a clamp 20, a fastener 22, and a biaser 24. The clamp 20 comprises a first element 26, which is slidably engaged to a second element 28. The clamp 20 is selectively positionable in an open configuration, as shown in FIGS. 3 and 6, and a retracted configuration, as shown in FIGS. 5 and 7. In the open configuration, a handle 30 of the dumbbell 18 is selectively positionable between the first element 26 and the second element 28. In the retracted configuration, the clamp 20 frictionally engages the handle 30 of the dumbbell 18.

The first element 26 comprises a first plate 32 and a second plate 34. The second plate 34 is engaged to and extends substantially perpendicularly from a lower end 36 of the first plate 32. The second element 28 comprises a third plate 38, which is slidably engaged by a bottom end 40 to the second plate 34 distal from the first plate 32.

As shown in FIG. 6, a pair of rods 44 is engaged to and extends from the third plate 38 proximate to the bottom end 40. A pair of channels 46 extends into the second plate 34. Each rod 44 extends from the third plate 38 into a respective channel. The third plate 38 is selectively extensible from the second plate 34 while remaining substantially parallel to the first plate 32. The clamp 20 is substantially C-shaped. The present invention anticipates more than two rods 44, as well as other configuration enabling sliding of the third plate 38, such as, but not limited to, a fourth plate (not shown) extensible from a cutout (not shown) positioned in the second plate 34.

The fastener 22 is engaged to the first element 26 and is configured to selectively engage the weightlifting belt 16 so that the clamp 20 is removably engaged to a respective opposed side 14 of the weightlifting belt 16. The fastener 22 may comprise a hooking element 48, which is configured to hook to the weightlifting belt 16, or other fastening means, such as, but not limited to, bolts, securable straps, and the like.

The hooking element 48 may comprise a first piece 50 and a second piece 52. The first piece 50 is engaged proximate to and extends substantially perpendicularly from an upper end 54 of the first plate 32. The first piece 50 extends opposingly to the second plate 34. The second piece 52 is engaged to and extends from the first piece 50 distal from the first plate 32. The second piece 52 extends substantially in parallel with the first plate 32 towards the lower end 36 of the first plate 32. The second piece 52 and the first plate 32 thus define a slot 56, which is configured for insertion of the weightlifting belt 16 to removably engage the clamp 20 to the weightlifting belt 16. An outer surface 42 of the second piece 52 may be planar, as shown in FIG. 3, although the present invention also anticipates the outer surface 42 being convex and substantially complementary to a curvature of the hip of the user. The hooking element 48 may comprise other hooking means, such as, but not limited to, curved rods, pairs of hooks, and the like.

The biaser 24 is engaged to the first element 26 and is operationally engaged to the second element 28. The biaser 24 is positioned to bias the clamp 20 to the retracted configuration. The biaser 24 may comprise a pair of springs 58, or other biasing means, such as, but not limited to, screw gears, elastic straps, and the like. Each spring 58 is engaged to and extends between a respective rod 44 and the second plate 34. The spring 58 is tensioned as the respective rod 44 is extended from an associated channel 46 when positioning the clamp 20 in the open configuration. The spring 58 is positioned to rebound to motivate the clamp 20 to the retracted configuration.

In use, the pair of clamping units 12 are mounted to the opposed sides 14 of the weightlifting belt 16 by inserting the weightlifting belt 16 into the slots 56. The weightlifting belt 16 then is donned by the user. The clamps 20 are sequentially positioned in the open configuration by pulling the third plate 38 laterally away from the first plate 32, at which point a handle 30 of a respective dumbbell 18 can be inserted into the clamp 20. Upon releasing the third plate 38, the spring 58 rebounds and the dumbbell 18 is secured in the clamp 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A weight attachment device comprising:

a pair of clamping units, each of the pair of clamping units being configured to be mountable to respective opposed side of a weightlifting belt, such that the pair of clamping units is configured to be positioned singly proximate to hips of a user upon donning of the weightlifting belt by the user, each of the pair of clamping units being configured for selectively engaging a respective dumbbell of a pair of dumbbells, such that the respective dumbbell is removably engaged to the respective clamping unit, wherein the pair of clamping units is configured for engaging a pair of dumbbells, such that the pair of dumbbells is configured to be positioned singly proximate to the hips of the user, positioning the user for performing exercises without using their hands to grasp the pair of dumbbells;

wherein each of the pair of clamping units comprises:

a clamp comprising a first element slidably engaged to a second element, such that the clamp is selectively positionable in an open configuration, where a handle of the respective dumbbell is selectively positionable between the first element and the second element, and a retracted configuration, wherein the clamp frictionally engages the handle of the respective dumbbell;

a fastener engaged to the first element and being configured for selectively engaging the weightlifting belt, such that the clamp is removably engaged to a respective opposed side of the weightlifting belt; and a biaser engaged to the first element and being operationally engaged to the second element, such that the biaser is positioned for biasing the clamp to the retracted configuration.

2. The weight attachment device of claim 1, wherein:

the first element comprises a first plate and a second plate, the second plate being engaged to and extending perpendicularly from a lower end of the first plate; and the second element comprises a third plate slidably engaged by a bottom end to the second plate distal from the first plate, such that the third plate is selectively extensible from the second plate while remaining parallel to the first plate, and such that the clamp is C-shaped.

3. The weight attachment device of claim 2, further including:

a pair of rods engaged to and extending from the third plate proximate to the bottom end;

a pair of channels extending into the second plate, each of the pair of rods extending from the third plate into a respective channel of the pair of channels; and the biaser comprising a pair of springs, each of the pair of springs being engaged to and extending between a respective rod of the pair of rods and the second plate, such that the respective spring is tensioned as the respective rod is extended from an associated channel for positioning the clamp in the open configuration, such that the respective spring is positioned for rebounding for motivating the respective clamp to the retracted configuration.

4. The weight attachment device of claim 2, wherein the fastener comprises a hooking element, the hooking element comprising:

a first piece engaged proximate to and extending perpendicularly from an upper end of the first plate, such that the first piece extends opposingly to the second plate; and a second piece engaged to and extending from the first piece distal from the first plate, the second piece extending in parallel with the first plate towards the lower end of the first plate, such that the second piece and the first plate define a slot, wherein the slot is configured for insertion of the weightlifting belt for removably engaging the respective clamp to the weightlifting belt.

5. The weight attachment device of claim 1, wherein the fastener comprises a hooking element, wherein the hooking element is configured for hooking to the weightlifting belt.

6. A weight attachment system comprising:

a weightlifting belt;

a pair of dumbbells;

a pair of clamping units, each of the pair of clamping units being mounted to respective opposed side of the weightlifting belt, such that the pair of clamping units are configured to be positioned singly proximate to hips of a user upon donning of the weightlifting belt by the user; and each of the pair of clamping units being selectively engageable a respective dumbbell of the pair of dumbbells, such that the respective dumbbell is removably engaged to the respective clamping unit, such that the pair of dumbbells are configured to be positioned singly proximate to the hips of the user, positioning the user for performing exercises without using their hands to grasp the pair of dumbbells;

wherein each of the pair of clamping units comprises:

a clamp comprising a first element slidably engaged to a second element, such that the clamp is selectively positionable in an open configuration, where a handle of the respective dumbbell is selectively positionable between the first element and the second element, and a retracted configuration, wherein the clamp frictionally engages the handle of the respective dumbbell;

a fastener engaged to the first element and being selectively engageable to the weightlifting belt, such that the clamp is removably engaged to a respective opposed side of the weightlifting belt; and a biaser engaged to the first element and being operationally engaged to the second element, such that the biaser is positioned for biasing the clamp to the retracted configuration.

7. The weight attachment system of claim 6, wherein:

the first element comprises a first plate and a second plate, the second plate being engaged to and extending perpendicularly from a lower end of the first plate; and the second element comprises a third plate slidably engaged by a bottom end to the second plate distal from the first plate, such that the third plate is selectively extensible from the second plate while remaining parallel to the first plate, and such that the clamp is C-shaped.

8. The weight attachment system of claim 7, further including:

a pair of rods engaged to and extending from the third plate proximate to the bottom end;

a pair of channels extending into the second plate, each of the pair of rods extending from the third plate into a respective channel of the pair of channels; and the biaser comprising a pair of springs, each of the pair of springs being engaged to and extending between a respective rod of the pair of rods and the second plate, such that the respective spring is tensioned as the respective rod is extended from an associated channel for positioning the clamp in the open configuration, such that the respective spring is positioned for rebounding for motivating the respective clamp to the retracted configuration.

9. The weight attachment system of claim 7, wherein the fastener comprises a hooking element, the hooking element comprising:

a first piece engaged proximate to and extending perpendicularly from an upper end of the first plate, such that the first piece extends opposingly to the second plate; and a second piece engaged to and extending from the first piece distal from the first plate, the second piece extending in parallel with the first plate towards the lower end of the first plate, such that the second piece and the first plate define a slot positioned for insertion of the weightlifting belt for removably engaging the respective clamp to the weightlifting belt.

10. The weight attachment system of claim 6, wherein the fastener comprises a hooking element, such that the hooking element is positioned for hooking to the weightlifting belt.

11. A weight attachment device comprising a pair of clamping units, each of the pair of clamping units being configured to be mountable to respective opposed side of a weightlifting belt, such that the pair of clamping units is configured to be positioned singly proximate to hips of a user upon donning of the weightlifting belt by the user, each of the pair of clamping units being configured for selectively engaging a respective dumbbell of a pair of dumbbells, such that the respective dumbbell is removably engaged to the clamping unit, wherein the pair of clamping units is configured for engaging the pair of dumbbells, such that the pair of dumbbells is configured to be positioned singly proximate to the hips of the user, positioning the user for performing exercises without using their hands to grasp the pair of dumbbells, each of the pair of clamping units comprising:

a clamp comprising a first element slidably engaged to a second element, such that the respective clamp is selectively positionable in an open configuration, where a handle of the respective dumbbell is selectively positionable between the first element and the second element, and a retracted configuration, wherein the clamp frictionally engages the handle of the respective dumbbell, the first element comprising a first plate and a second plate, the second plate being engaged to and extending perpendicularly from a lower end of the first plate, the second element comprising a third plate slidably engaged by a bottom end to the second plate distal from the first plate, such that the third plate is selectively extensible from the second plate while remaining parallel to the first plate, and such that the clamp is C-shaped;

a pair of rods engaged to and extending from the third plate proximate to the bottom end;

a pair of channels extending into the second plate, each of the pair of rods extending from the third plate into a respective channel of the pair of channels;

a fastener engaged to the first element and being configured for selectively engaging the weightlifting belt, such that the clamp is removably engaged to a respective opposed side of the weightlifting belt, the fastener comprising a hooking element, wherein the hooking element is configured for hooking to the weightlifting belt, the hooking element comprising:

a first piece engaged proximate to and extending perpendicularly from an upper end of the first plate, such that the first piece extends opposingly to the second plate, and a second piece engaged to and extending from the first piece distal from the first plate, the second piece extending in parallel with the first plate towards the lower end of the first plate, such that the second piece and the first plate define a slot, wherein the slot is configured for insertion of the weightlifting belt for removably engaging the clamp to the weightlifting belt; and a biaser engaged to the first element and being operationally engaged to the second element, such that the biaser is positioned for biasing the clamp to the retracted configuration, the biaser comprising a pair of springs, each of the pair of springs being engaged to and extending between a respective rod of the pair of rods and the second plate, such that the respective spring is tensioned as the respective rod is extended from an associated channel of the pair of channels for positioning the clamp in the open configuration, such that the respective spring is positioned for rebounding for motivating the clamp to the retracted configuration.

* * * * *